United States Patent [19]

Bogese, II

[11] 4,185,162

[45] Jan. 22, 1980

[54] MULTI-CONDUCTOR EMF CONTROLLED FLAT TRANSMISSION CABLE

[75] Inventor: Stephen B. Bogese, II, Roanoke, Va.

[73] Assignee: Virginia Plastics Company, Roanoke, Va.

[21] Appl. No.: 870,566

[22] Filed: Jan. 18, 1978

[51] Int. Cl.[2] ..... H01B 7/08; H01B 11/08

[52] U.S. Cl. ..... 174/32; 174/115; 174/117 F

[58] Field of Search ..... 333/96, 1, 84 R, 236, 333/243; 174/117 F, 117 FF, 113 R, 115, 117 R, 32, 36

[56] References Cited

U.S. PATENT DOCUMENTS

| | | | |
|---|---|---|---|
| 3,219,752 | 11/1965 | Harris | 174/117 R |
| 3,408,453 | 10/1968 | Shelton | 174/117 FF |
| 3,439,111 | 4/1969 | Miracle et al. | 174/107 |
| 3,735,022 | 5/1973 | Estep | 174/117 F |
| 3,775,552 | 11/1973 | Schumacher | 174/117 F |

FOREIGN PATENT DOCUMENTS

| | | | |
|---|---|---|---|
| 697919 | 11/1964 | Canada | 174/117 F |
| 2036798 | 12/1970 | France | 174/117 F |
| 1390152 | 4/1975 | United Kingdom | 174/117 F |

*Primary Examiner*—Bruce A. Reynolds
*Assistant Examiner*—E. F. Borchelt
*Attorney, Agent, or Firm*—Snider, Sterne & Saidman

[57] ABSTRACT

A multi-conductor flat transmission cable which includes a plurality of parallel signal conductors each of which is insulated with a low loss, high velocity of propagation material. The insulations surrounding a send and return conductor pair are joined by a homogeneous integrally formed EMF window web formed of the same material as the insulations. The thickness and length of the window webs are selected to control the electromagnetic interference between the conductor pair, as well as the impedance and capacitance. Individual, uninsulated screen conductors may be positioned between adjacent signal conductor pairs to further minimize EMF interference. The insulated signal conductors, their EMF window webs, and the uninsulated screen conductors are encapsulated by an upper and lower outer layer of insulation formed of a material having a velocity of propagation different from the signal conductor's insulations.

11 Claims, 6 Drawing Figures

MULTI-CONDUCTOR EMF CONTROLLED FLAT TRANSMISSION CABLE

BACKGROUND OF THE INVENTION

1. Field of the Invention

The present invention is related to flat transmission cables and, more particularly, is directed towards a multiconductor flat transmission cable whose EMF properties may be precisely controlled, and particularly with respect to such cables intended tor use in high speed communication systems.

2. Description of The Prior Art

It is well known that an electric current flowing through a conductor creates an electromagnetic field surrounding the conductor. The surrounding field can, in turn, induce a smaller electric current on other conductors located nearby. The induced current may either increase or decrease the signal magnitude on the adjacent conductor, and therefore can lead to signal errors.

Accordingly, signal bearing conductors are frequently insulated with a low loss material such as, for example, Teflon, which, because of its good dielectric properties, causes the electromagnetic field (EMF) of the conductor to cover a smaller area, thereby reducing the induced current effect of the insulated conductor.

In many communication systems, a conductor pair, known as a send conductor and a return conductor, are required for each signal to serve as either transmission verification or in order to provide system feedback. A common construction of conductor pairs utilizes two individually insulated conductors twisted together in such a fashion so that their respective EMF's are intended to largely cancel one another. In a large transmission cable, many sets of twisted pairs are aligned in a single plane between a pair of outer layers of usually laminated insulation.

A flat transmission cable configuration as above-described suffers from the deficiency that it is impossible to maintain intimate contact between the outer longitudinal layers of insulation and the individual insulations of the twisted pair of conductors. Air pockets are thereby trapped and, as the EMF travels through the air transition zones, the tendency is to distort the signal transmitted on the conductors which can lead to signal errors. Since the twisted insulated conductors vary in their center-to-center distance, the EMF cancellations also fluctuate.

To overcome the foregoing deficiences, it is quite well known to replace twisted conductors pairs with substantially parallel multi-conductor flat cables in which the conductors are totally encapsulated in a substantially homogeneous low loss insulation material. While eliminating the problem of signal distortion resulting from trapped air zones, most of the presently available flat cable designs still suffer from one or more disadvantages.

One of the disadvantages of present flat cable designs still results from uncontrolable EMF interference between adjacent conductors. Despite the elimination of the air pocket problem, control of EMF interference remains difficult.

Further, with the advent of faster computer speeds, higher data transmission rates between computer components and peripherals are required so as to minimize delays caused by waiting for information transfer. Another general problem, therefore, with presently available multi-conductor flat cables is their slow velocity of propagation rates. Present day cables also fail to make any provision for different signal transmission speeds within a single cable.

A further deficiency relates to excessive cost of manufacturing such cables. The extremely low loss, low dielectric constant, high velocity of propagation insulation material is relatively expensive compared to the more lossy, low velocity of propagation polymers. An efficient multiconductor cable design would therefore utilize the low dielectric constant material to the minimum extent necessary to achieve the desired cable characteristics. It may be appreciated that in mass production of such cables, if it were possible to replace even a small amount of the low dielectric constant material with a higher dielectric constant material, tremendous savings in manufacturing costs would be achieved. Many present flat cable designs, unfortunately, use the expensive polymers unnecessarily and wastefully over the signal conductors as well as the ground conductors.

U.S. Pat. No. 3,763,306 to Marshall exemplifies a multi-layer flat cable design wherein the ground conductors (which do not require a high propagation velocity) are embedded in the same layer and material as the signal conductors. This means that more expensive material with good properties is used around the ground conductors than is necessary, which results in a higher cable cost. Further, the material covering all the conductors has a fixed thickness which can allow uncontrolled EMF interference to bypass the ground conductors and induce false pulses on the adjacent signal conductors.

In U.S. Pat. No. 3,459,879, Gerpheide illustrates a two layer multi-conductor cable construction in which the ground conductors and the signal conductors are embedded in each layer in the same insulating material. Such a construction has the same drawbacks set forth above with respect to the Marshall design. In addition, in order to eliminate interference, Gerpheide positions the ground conductors of one layer opposite the signal conductors of the other layer to form a triad of ground conductors around each signal conductor. Clearly, the provision of two layers, each with extra conductors, results in a far greater cost than would otherwise be necessary. The construction illustrated in U.S. Pat. No. 3,179,904 to Paulsen is similar.

Multi-conductor transmission line cables are also known which utilize a homogeneous Teflon insulation over both the signal and ground conductors. Such a construction provides a very high propagation velocity, but utilizes the expensive Teflon insulator unnecessarily around the ground conductors.

U.S. Pat. No. 3,735,022 to Estep provides a partial solution to the shortcomings outlined above in teaching a multi-conductor cable design in which signal conductor pairs are first extruded in a low dielectric constant material, such as polyethylene or foam, and the extruded conductor pairs are then extruded once again in a jacket which consists of a lossy dielectric material, such as vinyl. The design of Estep eliminates circumferential air present in prior art twisted pair designs to reduce excess crosstalk, but nevertheless presents several difficulties of its own. Initially, no provision is made in Estep for controlling, to any desired degree, the amount of EMF interference between embedded conductor pairs. Additionally, Estep's design fails to take into account impedance and capacitance effects between adjacent conductors. That is, while it is frequently desirable to reduce cross-interference between conductor pairs as much as possible, other factors and parameters may require designs which permit the amount of EMF interference between the conductor pairs to be varied. Such factors include, for example, the capacitance between the conductors and the impedance of the cable, and are generally a function of the relationship between the two conductors to each another, including the amount of insulation contained between them, the dielectric properties of the insulation, the distance between the wires, and the like. In high speed signal communication cables, it is important to be able to achieve the desired capacitance and impedance, while still achieving a certain EMF cancellation.

The Estep construction specifies a conductor insulation having a rectangular, ellipsoid or circular cross-section, while the outer jacket is of generally rectangular cross-section. Such a construction is quite disadvantageous in terms of ease of termination of the cable. The circular, ellipsoid, or rectangular cross-sections contain two or more conductors with no clearly defined individual inner walls between them. As a result, it is extremely difficult to precisely locate and separate one conductor from the other conductor of a pair and obtain a flawless, uniform insulation layer around each conductor. Therefore, perfect connector termination is rarely attained and is very time-consuming to attempt. Further, an imperfectly terminated cable could result in field failures which cannot be detected at the time of termination.

Other U.S. patents of which I am aware which relate to multi-conductor flat cables include: U.S. Pat. Nos. 2,471,752; 3,439,111; 3,576,723; 3,600,500; 3,775,552; 3,800,065; 3,819,848; 3,833,755; and 3,865,972.

OBJECTS AND SUMMARY OF THE INVENTION

It is therefore a primary object of the present invention to provide a multi-conductor flat cable wherein the signal conductors are insulated by a low loss, low dielectric constant material, and wherein electromagnetic field interference between adjacent signal conductor pairs may be precisely controlled.

A general object of the present invention is to provide a multi-conductor flat transmission cable which overcomes all of the deficiencies noted above with respect to prior art designs.

An additional object of the present invention is to provide an inexpensive, versatile, and efficient multi-conductor cable design which may either minimize or maximize adjacent conductor EMF interference, as desired.

A further object of the present invention is to provide a flat multi-conductor transmission cable which minimizes the utilization of high propagation velocity, low loss insulation material so as to maximize efficiency and minimize production costs.

A still further object of the present invention is to provide a multi-conductor flat communication cable wherein the signal conductors are insulated by a low loss insulator, and the insulated signal conductors are maintained in a precise spatial relationship by an outer, laminated, relatively high dielectric constant material.

A still further object of the present invention is to provide a multi-conductor flat transmission cable which permits selection of different signal propagation velocities within one cable so as to permit customized cable design for any desired application.

A still additional object of the present invention is to provide a multi-conductor flat transmission cable in which the conductors are precisely spaced and easily located to permit rapid termination thereof with insulation displacement or insulation piercing connectors.

The foregoing and other objects are attained in accordance with one aspect of the present invention through the provision of a multi-conductor flat transmission cable, wherein certain pairs of adjacent signal conductors form a signal conductor group. Means are preferably provided for controlling the electromagnetic field interaction between the pair of adjacent conductors within each group. In a preferred embodiment, the means for controlling the electromagnetic field interaction comprises an EMF window web extending between and formed intergrally with the insulation polymer material that encloses each of the pair of adjacent conductors.

In accordance with other aspects of the present invention, certain of said signal conductor groups in the cable have relatively thick EMF window webs for permitting a relatively high degree of electromagnetic field interaction between adjacent conductor pairs, while other of the signal conductor groups have relatively thin EMF window webs for permitting a relatively low degree of electromagnetic field interaction between adjacent conductor pairs in such groups. Uninsulated screen conductors may be provided between adjacent conductor groups to further minimize EMF field interaction therebetween.

The EMF window web preferably comprises a substantially planar web material integrally formed of the same polymer as the insulation for the signal conductors within the group. The window web and insulation for the signal conductors may be simultaneously extruded and in a preferred embodiment comprises a fluoropolymer, such as Teflon.

A special case of the present invention occurs where the EMF window web thickness is reduced to zero. This provides optimum isolation between each conductor. More specifically, the multi-conductor flat transmission cable of this embodiment comprises a plurality of parallel, spaced signal conductors which are each enclosed by an insulation comprised of a polymer material having a relatively high velocity of propagation. The insulated signal conductors have a substantially circular uniform cross-section along their length. The cable further comprises a pair of outer layers encapsulating the plurality of insulated conductors in a fixed, spaced relationship and which is comprised of a material with a different velocity of propagation than the signal conductor insulation. The outer layers are each preferably of a substantially uniform thickness so as to conform to the shape of the insulated signal conductors to provide easy and accurate termination.

More particularly, the cable of the present invention may include a plurality of uninsulated screen conductors, one of which is positioned between adjacent ones of the plurality of insulated signal conductors for absorbing the electromagnetic field emanating from the adjacent insulated signal conductors.

In accordance with other aspects of the present invention, certain of the plurality of signal conductors may be insulated with a first polymer material, while others of the plurality of signal conductors may be insulated with a second polymer material, the first and second polymer materials having different velocities of propagation so as to accommodate different signal speeds and applicatiaons within a single cable.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
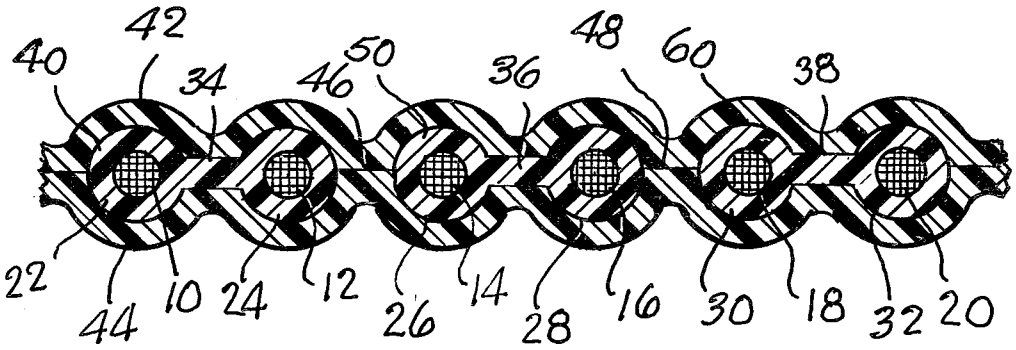
FIG. 1 is a cross-sectional view which illustrates one preferred embodiment of a multi-conductor flat transmission cable in accordance with the present invention.

Referring now to the drawings, wherein like reference numerals represent identical or corresponding parts throughout the several views, and more particularly to FIG. 1 thereof, a cross-section of one embodiment of a multi-conductor flat transmission cable is illustrated and is seen to comprise a plurality of elongated, parallel signal conductors 10, 12, 14, 16, 18 and 20.

The signal conductors 10, 12, 14, 16, 18 and 20 each may be an individual wire, or a multi-strand wire, each intended to carry but a single signal. The conductors 10 through 20 are each located in a single plane, and the cable is designed for use in high speed data communications where a high velocity of signal propagation is an important factor, as is careful control of EMF interference. To this end, the signal conductors 10 through 20 are arranged in conductor pairs 40, 50 and 60. Conductor pair 40 includes signal conductors 10 and 12, conductor pair 50 includes signal conductors 14 and 16, while conductor pair 60 includes signal conductors 18 and 20. Each of the conductor pairs 40, 50 and 60 include a send conductor and a return conductor, in a fashion analogous to the prior art twisted pair configurations.

Enclosing each of the signal conductors 10 through 20 is an insulation material which is preferably a high velocity of propagation, low loss, low dielectric constant material. Fluoropolymers are widely used as such insulators, and the fluoropolymer Teflon in particular provides an extremely low loss, high velocity propagation material suitable for high speed data communications. Insulating portions 22, 24, 26, 28, 30 and 32 respectively enclose signal conductors 10, 12, 14, 16, 18 and 20, and are uniformly circular in cross-section along the entire length of the cable.

Extending between and integrally formed with the insulators 22 and 24 is a preferably substantially planar EMF window web 34, which is preferably extruded at the same time as insulators 22 and 24 about conductors 10 and 12. EMF window web 34 along with insulators 22 and 24 and signal conductors 10 and 12 form a signal conductor group 40. Importantly, the EMF window web 34, while being integrally joined and formed with the conductor insulations 22 and 24, may have a thickness and length which is independent of the thickness of the conductor insulators 22 and 24.

In the particular preferred embodiment illustrated in FIG. 1, conductor insulators 26 and 28 are also joined by an integral, homogeneous EMF window web 36, and conductor insulators 30 and 32 are likewise joined by an EMF window web 38.

The window webs 34, 36 and 38, with their associated conductor insulators and signal conductors, in FIG. 1 form three signal conductor pair groups 40, 50 and 60. The groups 40, 50 and 60 are held in a precise, desired spatial relationship by an upper layer 42 and a lower layer 44 of additional insulation. The upper and lower layers 42 and 44 are preferably comprised of a material which has a velocity of propagation which is different, generally lower, than that of the conductor insulators 22 through 32. The lower velocity of propagation, high dielectric constant outer layers 42 and 44 may, for example, comprise polyvinylchloride (PVC), Polyester, ETFE (e.g. Tefzel ®), or ECTFE (e.g. Halar ®). The outer layers 42 and 44 are preferably laminated so as to maintain intimate contact between the outer surfaces of signal conductor groups 40, 50 and 60, as well as to ensure intimate contact with one another in those areas between adjacent conductor groups, denoted by reference numerals 46 and 48 in FIG. 1.

The EMF window webs 34, 36 and 38 provide means for allowing a precise and selectable amount of the EMF from both signal conductors within each group to field cancel one another. Much of the non-cancelled EMF is dissipated through the medium-to-low velocity of propagation outer layers 42 and 44. The cross-section of the cable to identical along its entire length, and therefore the longitudinally applied outer layers 42 and 44 may maintain complete and intimate contact with all conductor insulators and EMF window webs. As compared with twisted pair conductors, the design of FIG. 1 eliminates signal-distorting air pockets, and the window webs 34, 36 and 38 provide precise control of conductor pair spacing. Note that no window webs join conductor pair groups 40, 50 and 60 to achieve a minimum level of interference to provide maximum isolation between adjacent conductor groups. The outer layers 42 and 44 thereby completely encapsulate the conductor groups 40, 50 and 60 to provide a substantial EMF reduction by dissipating the fields.

The outer layers 42 and 44 are of preferably uniform thickness so as to conform to the outer periphery of the conductor pair groups 40, 50 and 60. Owing to the circular cross-section of the insulated conductors, the outer layers 42 and 44 provide a readily visible indication of the location of the signal conductors to facilitate and provide accurate connector termination of the cable.

Figure 2:
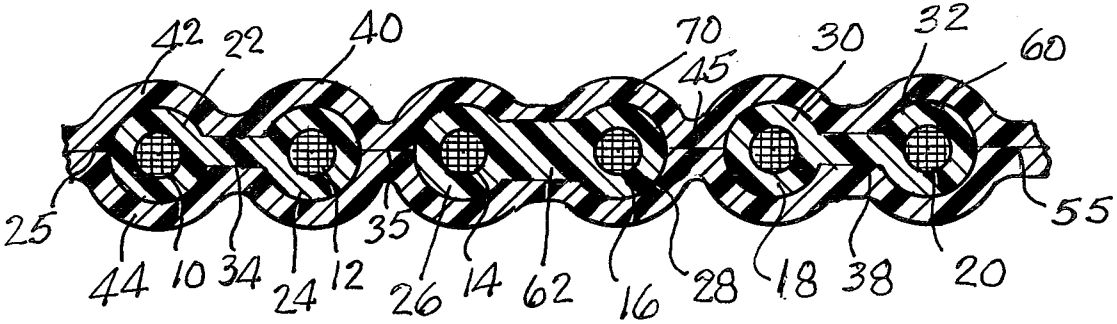
FIG. 2 is a cross-sectional view of an alternative preferred embodiment of the present invention.

Referring now to FIG. 2, there is illustrated an alternative preferred embodiment of a cable construction in accordance with the present invention which includes signal conductors 10, 12, 14, 16, 18 and 20. Each of the conductors 10 through 20 is again insulated with a high velocity of propagation, low loss material, such as Teflon, as indicated by reference numerals 22, 24, 26, 28, 30 and 32. Between adjacent conductor pairs 10–12, 14–16, and 18–20 are again positioned homogeneous, integrally formed and connecting EMF window webs 34, 62 and 38. The window webs and associated conductors and insulators again form three signal conductor pair groups indicated by reference numerals 40, 70 and 60. The preferred embodiment illustrated in FIG. 2 illustrates the utilization of window webs having differing thicknesses. For example, webs 34 and 38 may have a thickness of approximately 0.010 inch which permits a relatively small amount of EMF cross-cancellation to occur between conductor pairs 10–12 and 18–20, respectively. In contrast, EMF window web 62 may have a thickness on the order of approximately 0.025 inch which permits a relatively greater degree of EMF cross-cancellation to occur between signal conductors 14 and 16. This may be useful, for example, where conductor pair group 70 is utilized for a higher speed communications transmission, and it is therefore necessary to ensure a greater degree of EMF cross-cancellation than is necessary, for example, with signal pair conductor groups 40 and 60. Other factors affecting the desired thickness and length of the EMF window webs include the desired capacitance and impedance of the conductors and cable and the like. Narrowing of the window webs, as at 34 and 38, while leading to less EMF cross-cancellation, may nevertheless offer other more desirable operating parameters, while still maintaining crosstalk at a somewhat higher but acceptable level for certain applications.

In FIG. 2, the contour hugging outer layers 42 and 44, preferably comprised of lower velocity of propagation materials, eliminate signal-distorting air pockets, and yet permit the desired degree of EMF cross-cancellation to occur through the preformed window webs. Reduced EMF between unrelated conductor groups 40, 70 and 60 is accomplished by virtue of the outer layers 42 and 44 contacting themselves, as indicated by reference numerals 25, 35, 45 and 55, thereby dissipating any stray fields.

Figure 3:
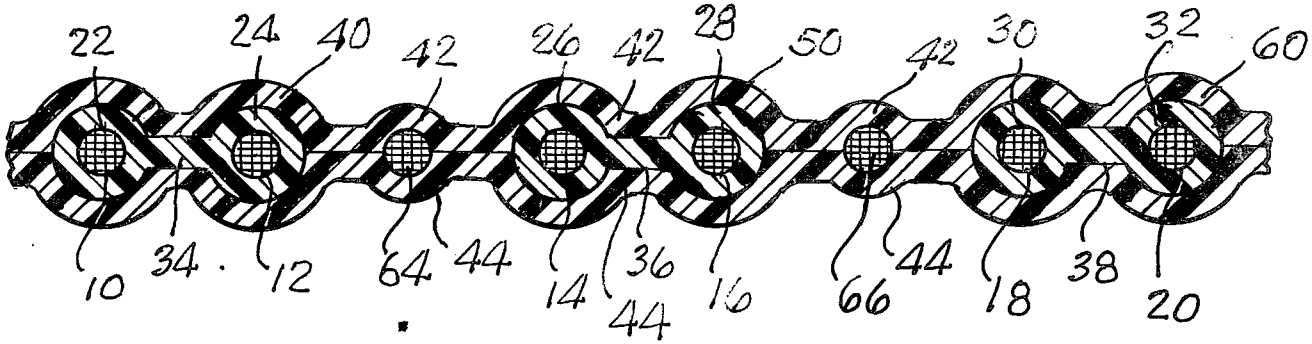
FIG. 3 is a cross-sectional view which illustrates yet another alternative embodiment of a transmission cable according to the present invention.

FIG. 3 illustrates yet another alternative embodiment of the present invention which includes identical signal conductor pair groups 40, 50 and 60 and outer laminated layers 42 and 44 as in the embodiment of FIG. 1. However, the embodiment of FIG. 3 provides even greater improvement in EMF control between adjacent conductor groups 40, 50 and 60 by the provision of uninsulated screen conductors 64 and 66. Screen conductor 64 is placed intermediate signal conductor pair groups 40 and 50, while screen conductor 66 is placed intermediate signal conductor pair groups 50 and 60. The uninsulated screen conductors 64 and 66 are intimately encapsulated by the outer layers 42 and 44. The screen conductors 64 and 66 provide EMF absorption, in addition to the EMF dissipation which accrues by virtue of the outer layers 42 and 44. Accordingly, the design of FIG. 3 may be utilized in those special applications where EMF isolation between adjacent signal conductor groups is critical.

Note with respect to FIG. 3 that the relatively expensive, low dielectric constant, low loss, insulator material is utilized only about the signal carrying conductors 10 through 20, as well as the field controlling EMF window webs 34, 36 and 38. None of the expensive insulator is utilized about the screen conductors 64 and 66 which provides an economical product. The only material adjacent the screen conductors 64 and 66 are the outer layers 42 and 44 which are of uniform thickness along their length, which also minimizes material waste.

Figure 4:
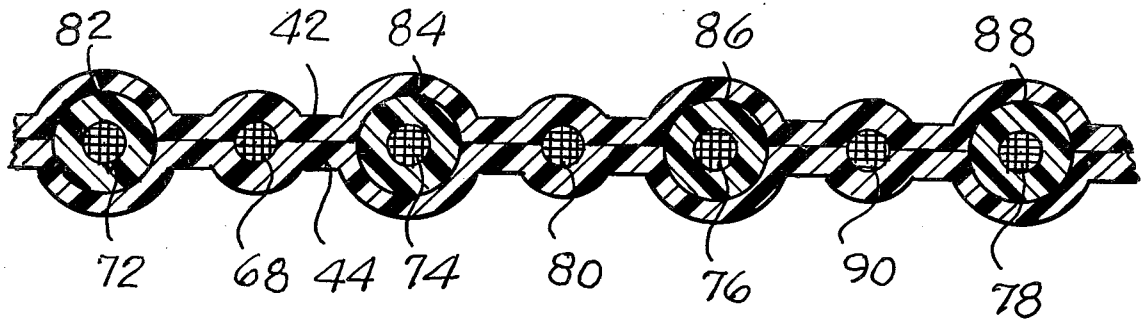
FIG. 4 illustrates still another alternate embodiment of a flat transmission cable having multiple conductors in accordance with the teachings of the present invention.

FIG. 4 illustrates an alternative embodiment of the present invention, and may be thought of as a special case wherein no EMF cross-cancellation is desired between conductors and maximum isolation is required. This is achieved by having EMF window webs of zero thickness between such conductors. Illustrated in FIG. 4 are four signal conductors 72, 74, 76 and 78, each of which include a low dielectric constant insulator 82, 84, 86 and 88, respectively. Positioned between the adjacent signal conductors 72 through 78 are uninsulated screen conductors 68, 80 and 90, while the outer layers 42 and 44 of lossy, relatively high dielectric constant lamination serves to position the insulated signal conductors and uninsulated screen conductors in a precise spatial relationship. The design of FIG. 4 is, for example, particularly well suited for extremely high speed transmission between computer components where transmission is uni-directional, and therefore does not require a return conductor. Each of the signal conductors 72, 74, 76 and 78 are isolated between one another by virtue of their surrounding low loss insulation and the interposed screen conductors 68, 80 and 90.

Figure 5:
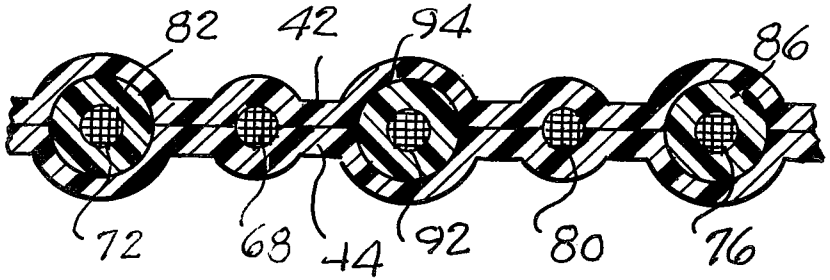
FIG. 5 is a cross-sectional view of still another alternate embodiment of the present invention.

Referring now to FIG. 5, an alternate embodiment of the present invention is illustrated which is basically a variation of the embodiment of FIG. 4. In FIG. 5, two signal conductors 72 and 76 are insulated with an extremely low loss, high velocity of propagation of material 82 and 86, such as Teflon. Signal conductor 92, on the other hand, is encased by a polyolefin insulation 94, so as to provide a moderately high velocity of propagation for conductor 92 without incurring the high cost of, for example, Teflon ®. Interposed between adjacent signal conductors 72 and 92 is an uninsulated screen conductor 68, while an uninsulated screen conductor 80 separates insulated conductors 92 and 76. All of the conductors are intimately encapsulated by the relatively lossy outer layers 42 and 44 as in the previous embodiments.

The construction of FIG. 5 is designed to provide various transmission speeds within a single cable. This permits several devices having different response times to be handled through a single interconnect cable. All conductors are isolated from one another and have uninsulated screen conductors to further reduce any adjacent EMF signal distortion.

Figure 6:
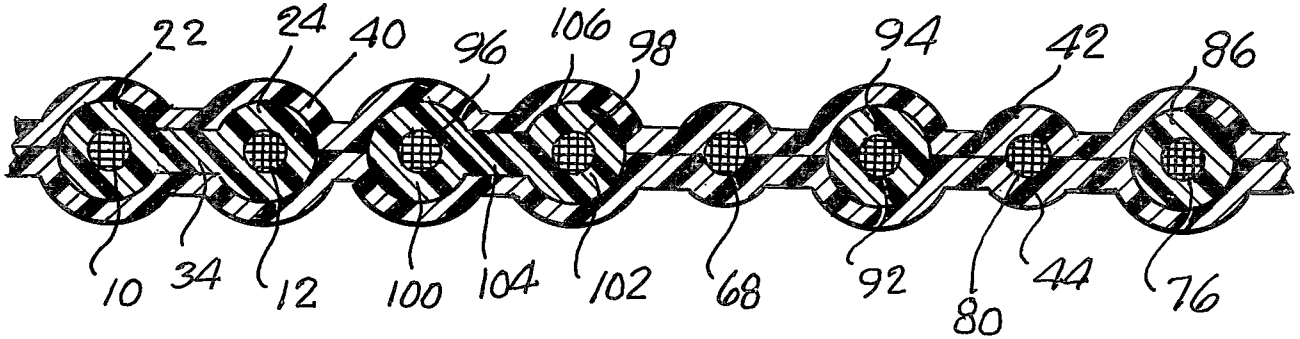
FIG. 6 is a cross-sectional view of yet another alternative preferred embodiment of a multi-conductor flat communication cable in accordance with the teachings of the present invention.

Referring now to FIG. 6, there is illustrated another possible embodiment which incorporates several of the features described above with respect to FIGS. 1 through 5 in a single multi-mode multi-use communication cable. Six signal conductors 10, 12, 96, 98, 92 and 76 are illustrated, each having an associated low dielectric constant, high velocity of propagation insulator 22, 24, 100, 102, 94 and 86, respectively. Insulators 22 and 24 are preferably comprised of Teflon for maximum velocity of propagation, as is the integral, homogeneous EMF window web 34 connecting insulators 22 and 24.

Insulators 100 and 102 may, for example, comprise ETFE with an integral EMF window web 104 positioned therebetween. ETFE has a sowewhat lower velocity of propagation and higher dielectric constant than Teflon, and accordingly the signal carrying characteristics of conductors 96 and 98 will differ somewhat from those of conductors 10 and 12.

Conductor 92 may be provided with a polyolefin insulation 94 to provide yet another distinct signal carrying characteristic within the cable. Insulation 86 for signal conductor 76 may be comprised of Teflon.

Interposed between signal conductor pair group 106 and signal conductor 92 is an uninsulated screen conductor 68, and an uninsulated screen conductor 80 is positioned between conductors 92 and 76. Maximum isolation is therefore achieved between conductor group 106 and conductor 92, as is between conductors 92 and 76. A certain degree of EMF cross-cancellation will be permitted by EMF window web 34 in the signal conductor group 40, while a certain degree will be permitted in group 106, depending upon the precise length and thickness of the EMF window webs 34 and 104, respectively.

Obviously, numerous modifications and variations of the present invention are possible in light of the above teachings. It is therefore to be understood that within the scope of the appended claims, the invention may be practiced otherwise than as specifically described herein.

I claim as my invention:

1. A multi-conductor flat transmission cable, which comprises:

a plurality of parallel, spaced signal conductors arranged in a plurality of signal conductor groups, each of said groups comprising a pair of adjacent signal conductors which consist of a send conductor and a return conductor for data communication, each of said signal conductors enclosed by an insulation comprised of a polymer material having a relatively high velocity of propagation, each signal conductor and its associated insulation having a substantially circular uniform cross-section along its length;

a pair of outer layers encapsulating said plurality of insulated conductors in a fixed, spaced relationship and comprised of a material with a different velocity of propagation than said signal conductor insulation; and means for controlling the electromagnetic field interaction between said send conductor and said return conductor in each of said groups which comprises a substantially planar EMF window web extending between and formed integrally with the insulation polymer material that encloses said send conductor and said return conductor the thickness of said web being less than the outer diameter of said insulation polymer material.

2. The multi-conductor transmission cable as set forth in claim 1, wherein certain of said plurality of signal conductors are insulated with a first polymer material, while others of said plurality of signal conductors are insulated with a second polymer material, said first and second polymer materials having different velocities of propagation.

3. The multi-conductor transmission cable as set forth in claim 2, further comprising a plurality of uninsulated screen conductors, one of which is positioned between adjacent ones of said plurality of insulated signal conductors for absorbing the electromagnetic field emanating from said adjacent insulated signal conductors.

4. The multi-conductor transmission cable as set forth in claim 1, wherein said EMF window web comprises a substantially planar web of material integrally formed of the same polymer as said insulation for said signal conductors in said group.

5. The multi-conductor transmission cable as set forth in claim 1, wherein said means for encapsulating comprises a pair of outer layers which are each of substantially uniform thickness.

6. A multi-conductor flat transmission cable, which comprises:

a plurality of parallel, spaced signal conductors, each of said signal conductors enclosed by an insulation comprised of a polymer material having a relatively high velocity of propagation, the insulated signal conductors having a substantially circular uniform cross-section along their length;

a pair of substantially uniform thickness outer layers encapsulating by contacting the entire outer surface of said plurality of insulated conductors to maintain same in a fixed, spaced relationship and comprised of a material with a different velocity of propagation than said signal conductor insulation; and a plurality of uninsulated screen conductors also encapsulated by said pair of outer layers, one of said screen conductors being positioned between adjacent ones of said plurality of insulated signal conductors for absorbing the electromagnetic field emanating from said adjacent insulated signal conductors, said pair of outer layer directly contacting one another on both sides of said uninsulated screen conductor to form a planar web of insulation between each of said uninsulated screen conductors and the adjacent insulated signal conductor, said planar web having a thickness less than the outer diameter of that portion of said outer layers that encapsulates said uninsulated screen conductors.

7. A multi-conductor flat transmission cable, which comprises:

a plurality of parallel, spaced signal conductors, each of said signal conductors enclosed by an insulation comprised of a polymer material having a relatively high velocity of propagation, the insulated signal conductors having a substantially circular uniform cross-section along their length;

means for encapsulating the entire outer surface of said plurality of insulated conductors in a fixed, spaced relationship and comprised of a material with a different velocity of propagation than said signal conductor insulation;

wherein certain pairs of adjacent conductors of said plurality of signal conductors form a plurality of signal conductor groups, and further including means for controlling the electromagnetic field interaction between said pair of adjacent conductors within each group which comprises an EMF window web extending between and formed integrally with the high velocity of propogation insulation polymer material that encloses each of said conductors in said group;

wherein certain signal conductor groups in said cable have relatively thick EMF window webs for permitting a relatively high degree of electromagnetic field interaction between adjacent conductor pairs in said certain groups, while other of said signal conductor groups in said cable have relatively thin EMF window webs for permitting a relatively low degree of electromagnetic field interaction between adjacent conductor pairs in said other groups.

8. The multi-conductor transmission cable as set forth in claim 7, further comprising a plurality of uninsulated screen conductors, one of which is positioned between adjacent ones of said plurality of insulated conductor groups for absorbing the electromagnetic field emanating from said adjacent insulated signal conductors.

9. A multi-conductor flat transmission cable, which comprises:

at least three parallel, spaced signal conductors, each of said signal conductors enclosed by a first insulation comprised of a polymer material having a relatively high velocity of propagation, each signal conductor and its respective insulation having a substantially circular uniform cross-section along its length; and insulation means positioned between each of said conductors for controlling the electromagnetic field interaction between said adjacent conductors, insulation means being relatively thick between certain of said adjacent conductors and relatively thin between others of said adjacent conductors.

10. A multi-conductor flat transmission cable as set forth in claim 9, wherein said insulation means comprises webs of said first insulation extending between and formed integrally with said polymer material that surrounds said adjacent conductors.

11. A multi-conductor flat transmission cable as set forth in claim 10, wherein said insulation means further comprises a material having a different velocity of propagation than said first insulation, said material encapsulating said first insulation of each of said conductors and said webs.

* * * * *